US006269753B1

(12) United States Patent
Roddan

(10) Patent No.: US 6,269,753 B1
(45) Date of Patent: Aug. 7, 2001

(54) CANTILEVERED, ADJUSTABLE, PORTABLE COMPUTER DESK

(76) Inventor: Allison C. Roddan, 228 Monarch Bay, Monarch Beach, CA (US) 92629-3435

( * ) Notice: Subject to any disclaimer, the term of this patent is extended or adjusted under 35 U.S.C. 154(b) by 0 days.

(21) Appl. No.: 09/179,011

(22) Filed: Oct. 26, 1998

(51) Int. Cl.[7] ..... A47B 37/00
(52) U.S. Cl. ..... 108/50.01; 108/50.02
(58) Field of Search ..... 108/50.01, 50.02, 108/144.11, 143, 49

(56) References Cited

U.S. PATENT DOCUMENTS

| | | | | |
|---|---|---|---|---|
| 2,193,907 | * | 3/1940 | Love | 108/49 X |
| 4,852,500 | * | 8/1989 | Ryburg et al. | 108/50.01 X |
| 4,932,332 | * | 6/1990 | Noda | 108/50.02 |
| 5,129,702 | * | 7/1992 | Ervin | 108/49 X |
| 5,357,874 | * | 10/1994 | Palmer | 108/50.02 |
| 5,473,997 | * | 12/1995 | Solomon et al. | 108/49 X |
| 5,568,773 | * | 10/1996 | Hung | 108/50.02 |
| 5,606,918 | * | 3/1997 | Cauffiel | 108/49 X |
| 5,715,761 | * | 2/1998 | Frattini | 108/50.02 |
| 5,752,449 | * | 5/1998 | Simon et al. | 108/50.02 |

* cited by examiner

*Primary Examiner*—Jose V. Chen
(74) *Attorney, Agent, or Firm*—Sharon Roddan, Esq.

(57) ABSTRACT

A cantilevered, telescopic, portable and adaptable computer desk to support and self-contain work space including a standard computer tower or desktop computer and all the associated peripherals, such as the keyboard, the mouse, the screen, the printer and other electronic devices. The computer desk provides numerous ways to adjust the position of the work area; the computer screen is adjustable, the desk member is adjustable both in the horizontal and vertical planes, the keyboard is adjustable, the mouse pad is adjustable and the base is adjustable. The computer desk may be used by a person working for long, tiring period at a computer desk or a person needing to be lying in a bed or on a sofa. In addition, the structure adapts to other various body positions. Someone standing up, seated in an upright chair or a wheelchair or resting or reclining in a favorite chair or recliner may use the structure. The disclosure permits the human to interface with the elements of the computer system in the most comfortable, adaptable and ergonomic positions. This unique computer desk is inexpensive to make, aesthetically pleasing and provides the healthy or handicapped user with an unlimited number of variations in adaptability, adjustability, and application.

21 Claims, 6 Drawing Sheets

FIG. 7
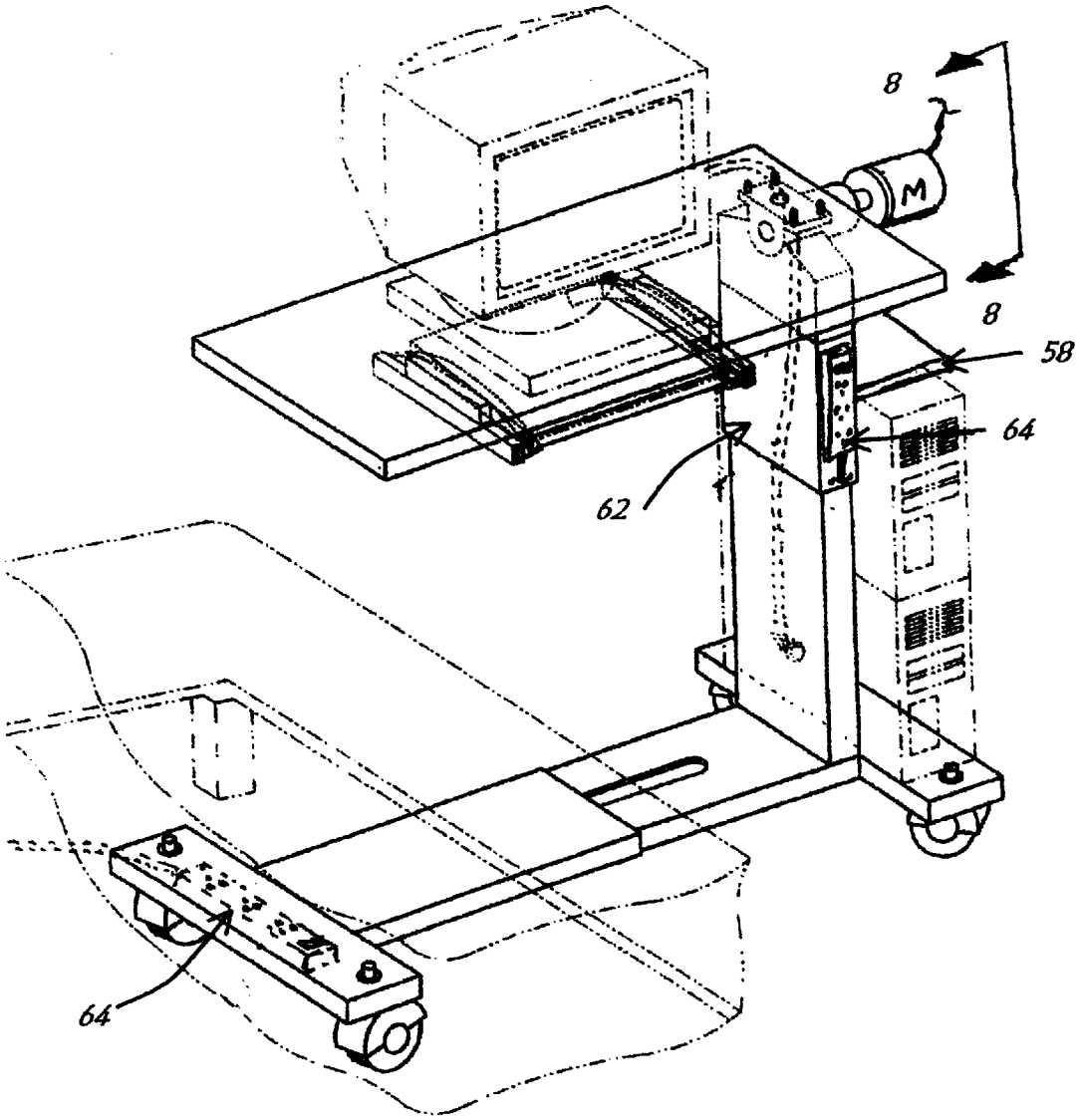
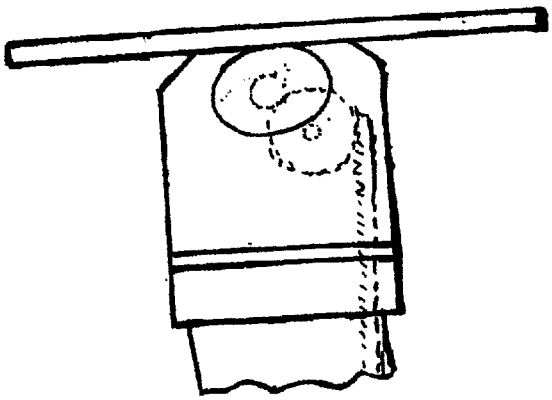
FIG. 8

CANTILEVERED, ADJUSTABLE, PORTABLE COMPUTER DESK

BACKGROUND-FIELD OF INVENTION

The present invention relates to a cantilevered computer desk. More particularly, the present invention relates to a cantilevered desk surface mounted on a movable base by a telescopic support or pedestal. The invention permits healthy, disabled or handicapped persons to utilize a computer comfortably and conveniently while seated in any type of chair or wheelchair, or while standing or while lying in a recliner, on a sofa or in a bed.

BACKGROUND-DESCRIPTION OF PRIOR ART

The personal computer (PC) is now a common tool in modern society. As software development and Internet usage proliferates, it is not uncommon for an individual to spend many hours per day working or playing on a personal computer. As wonderful as the personal computer is, it is without dispute that it also comes with inherent problems. When a person remains in the same position for hours at a time, even healthy muscles tend to fatigue. Over time, fatigued muscles spasm causing pain and stress related injuries. There is a need for an improved computer desk that is adjustable, adaptable, portable, selfcontained, and inexpensive to make.

Furthermore, the personal computer provides disabled or handicapped persons hours of productive work or entertainment. Yet many sick, tired, injured, disabled or handicapped people are precluded from using a computer since they cannot sit in an upright chair for long periods of time. Until this invention there was not an easy and inexpensive way to adapt a computer to fit each person's unique and changing needs or particular limitations.

Computer tables are well known in the prior art. While over the years, novel adaptations for computer tables have been developed in an attempt to address the problems encountered from the explosive growth of the personal computer.

U.S. Pat. No. 4,815,391 issued to Lee in 1989 was an attempt to invent a wheeled adjustment computer desk. While this early attempt at a computer table was adjustable and portable, it is limited in its application to someone sitting in an upright chair directly in front of the table. One could not use the Lee patent while lying in a recliner, on a sofa, or in a bed as the stationary legs of the desk prohibit access. While the Lee invention attempts to solve the problem of height-adjustment and portability, its application is undoubtedly marginal since in the ten years since the patent issued, the invention has not met with commercial success.

Another very inferior patent is set forth in U.S. Pat. No. 5,660,450 issued to Huang in 1997. While this is another attempt at a computer desk, the invention has no adjustment means or means for moving the desk.

A different Huang patent, also issued in 1997 as U.S. Pat. No. 5,623,881, is for a computer desk and has swivel wheels for moving, but the invention fails to provide any adjustment means and, like all the others, the dual or quad stationary legs prohibit access of the desk to many desired locations.

Devices have been disclosed which permit a user to utilize a personal computer while bedridden. One such device is U.S. Pat. No. 4,848,710 issued to Newman in 1989. While this device may have application to a bedridden person, it does not address the issue of a person who is ambulatory and merely suffering from muscle strain nor does it address the person confined to a wheelchair, setting in various chairs, or using a computer while standing.

Finally, U.S. Pat. No. 5,630,566 issued to Case in 1997 describes a portable ergonomic workstation. However, this invention is limited to holding only a light-weight, flat screen whereas my invention accommodates a standard computer tower and standard monitor. In addition, the Case patent is expensive to manufacture. It consists of a plurality of articulating arm elements. It provides no actual desk space. And, it lacks aesthetic appeal as it looks like a handicapped appliance.

Thus, the foregoing body of prior art indicates it to be well known to use a base and shelving elements to support a computer. However, the prior art has not contemplated the provision of a cantilevered, telescopic, movable and adaptable device to support and self-contain a standard computer tower or desktop computer enclosure, and all the associated peripherals, including the keyboard, the mouse, the screen, the printer and any other electronic devices, which may be employed by a person working for long, tiring periods at a computer desk or a person needing to be in bed, in a wheelchair, or other various body positions. Nor is a device contemplated which may be employed by a person standing or reclining in his or her favorite chair, which permits the human interface elements of the computer system to be placed in the most comfortable and ergonomic position during use. The foregoing disadvantages are overcome by the unique cantilevered, telescopic, adjustable, movable and self-contained computer desk of the instant invention as will be made apparent from the following description thereof. This unique computer desk is inexpensive to make, aesthetically pleasing and provides the user with an unlimited number of variations in adaptability, adjustably, and application. Other advantages of the present invention over the prior art also will be rendered evident. The teachings of the present invention addresses this long-standing and unmet need.

SUMMARY OF THE INVENTION

To achieve the foregoing and other advantages, a cantilevered, telescopic, and adjustable computer desk, briefly described, provides a device which will permit a healthy or disabled individual to operate a computer in a convenient and comfortable fashion from a bed, a wheelchair, or in a sitting or standing position. The computer desk is portable and includes a variety of adjustable support elements which may hold and support standard computer components including the keyboard, the screen, the mouse and pad, a workspace area, as well as the computer itself. Other electronic elements, such as a power strip, printer, scanner, fax machine, copier, television, etc. may be employed with the computer desk as well. The computer desk includes a plurality of elements which may be adjusted to such a configuration to permit a standing, sitting, or reclining, or lying individual to be able to utilize the computer from a bed, a sofa, a reclining chair, an upright chair, desk chair or a wheelchair.

The elements of the preferred embodiment of the cantilevered, telescopic computer desk comprise a base assembly, the base assembly having spaced apart end members joined by an intermediate member perpendicular thereto. The perpendicular member may be fixed or adjustable. Castors are affixed to the base assembly, preferably on the underside of the end members to support the base assembly above the floor and permit the computer desk to be moved about and easily portable. The castor may include braking elements that may be locked to secure the computer desk in position.

Upstanding from one end of the base assembly is a vertical telescopic support member which carries a cantilevered desk parallel to the base assembly so as to extend in the same direction from the telescopic support. Thus, the base assembly may be rolled to or placed underneath a bed, sofa, reclining chair, wheelchair or upright chair so that the desk is cantilevered over the user in the proper and most comfortable position for use. The vertical telescopic support member provides a means for adjusting the height of the cantilevered desk accommodating user positions ranging from standing to seating to lying.

The cantilevered desk has a means to receive a computer monitor and display and to provide a computer user space to work or space for receiving other items, such as, for example, a book holder, a television, or to permit unobstructed viewing of a television placed in a remote location in the room.

The cantilevered desk has an adjustable means to receive a keyboard such as a retractable, keyboard drawer and a retractable mouse platen or platens. The keyboard drawer has a means to adjust the angle of the keyboard relative to the user. The cantilevered desk also has affixed thereto an adjustable means to receive a pad and a mouse. The computer desk may also have a means for lighting.

The vertical telescopic support member has a means to receive a standard computer and a means to receive a printer or other electronic devices. Furthermore, the vertical telescopic support member may be hollow in the center to hold various electrical wires (i.e.: fiber optic, analog, digital, video or audio) for the electronic devices within the vertical support section. The computer desk may have a power strip affixed to base end member and/or the vertical support section.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the invention, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable ergonomic computer desk which may be utilized efficiently and comfortably by a healthy, disabled or handicapped individual in either a home, hospital or office.

It is an object of the invention to provide a new and improved computer desk that may be used in a number of positions while standing, seated, reclining or lying.

It is an object of the invention to provide a new and improved computer desk that may be used by a person in a wheelchair, a regular chair, a recliner, a sofa or a bed.

It is an object of the invention to provide a new and improved computer desk which is self-contained having a movable base, a telescopic vertical support means and an adjustable, cantilevered desk with an adjustable keyboard and an adjustable mouse pad, the computer desk assembly having a means to receive standard computer elements.

It is an object of the invention to provide a new and improved portable ergonomic computer desk that has the advantages of the prior art and overcomes the disadvantages of the prior art.

It is another object of the present invention to provide a new an improved portable, ergonomic computer desk, which may be easily and efficiently manufactured and marketed.

It is a further objective of the present invention to provide a new and improved portable ergonomic computer desk, which is of durable and reliable construction.

It is a further objective of the present invention to provide a new and improved portable ergonomic computer desk, which is aesthetically pleasing.

An even further object of the present invention is to provide a new and improved portable ergonomic computer desk which is inexpensive to manufacture with regard to both materials and labor, and which accordingly is then affordable to the consuming public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 7 is a view showing the power strip(s), the hollow vertical support member, the means for receiving a printer or other electronic devices, and the motorized adjustment means.

FIG. 8 is a cross-sectional view showing an alternative adjustment means.

DESCRIPTION OF THE PREFERRED EMBODIMENT

Figure 1:
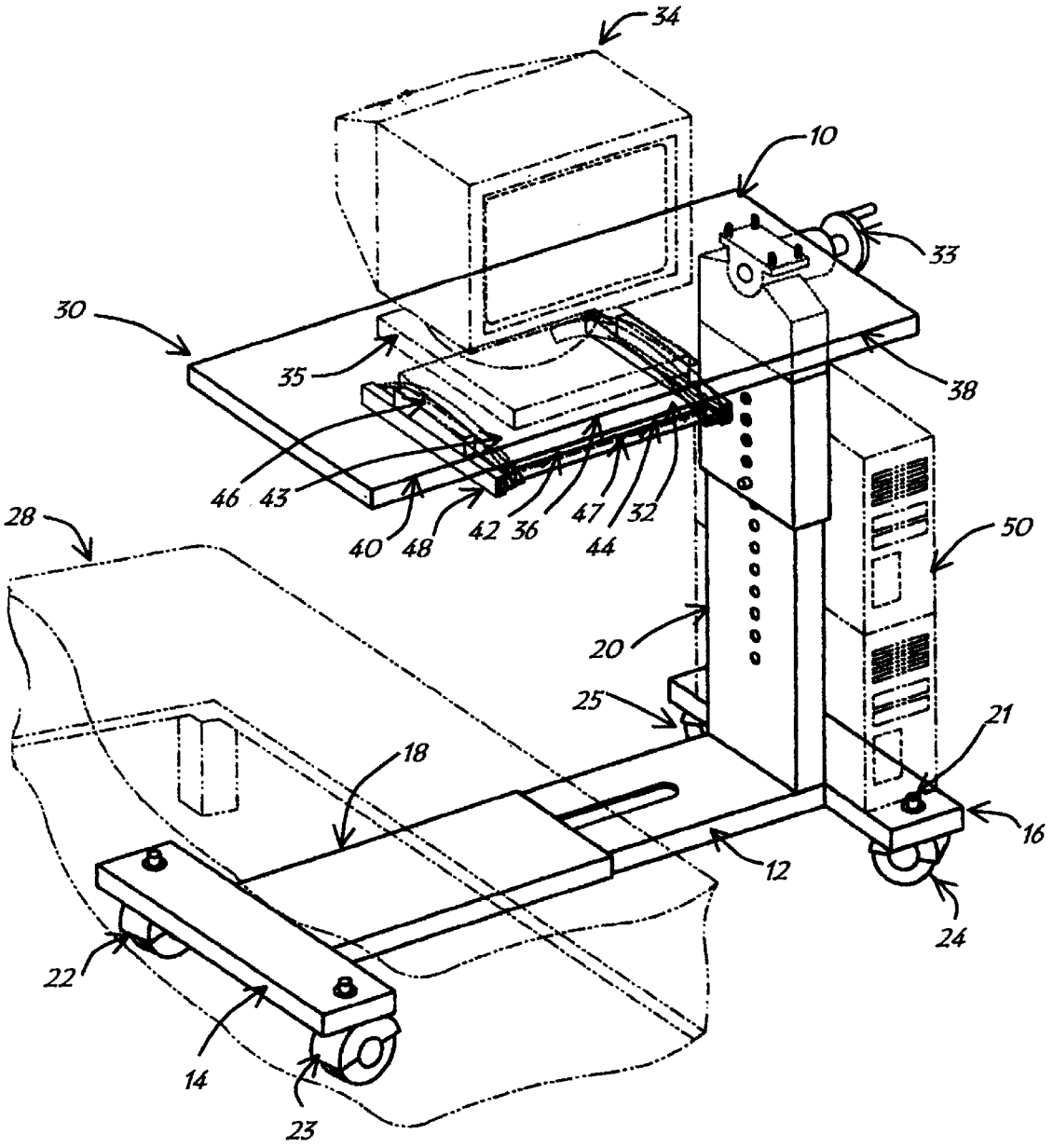
FIG. 1 is a view showing the cantilevered, adjustable computer desk of the invention.
Figure 3:
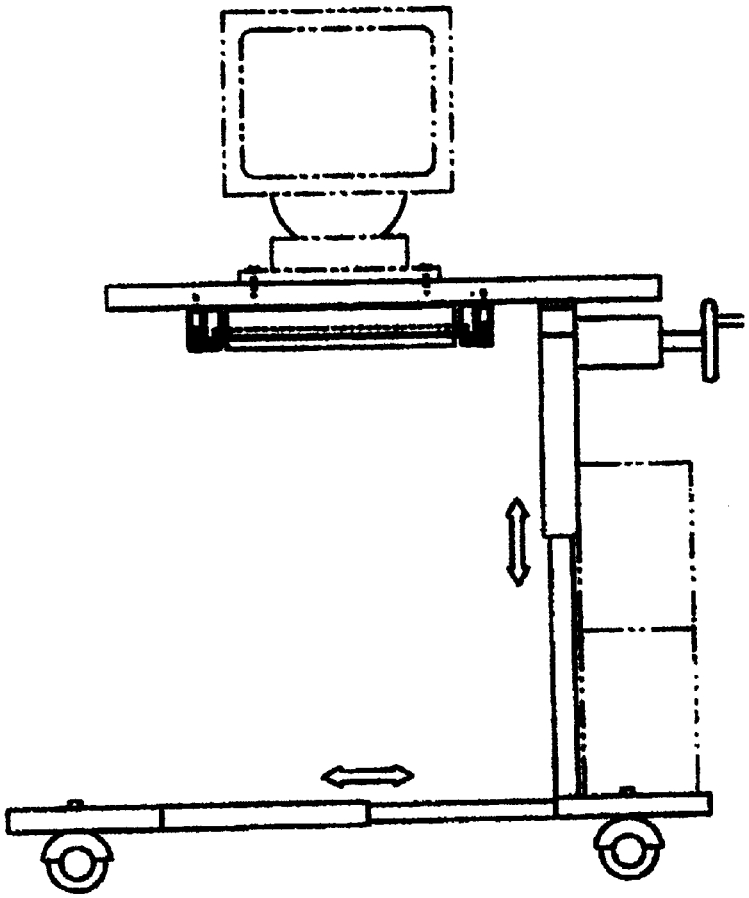
FIG. 3 is a front view showing the cantilevered, adjustable computer desk of the invention.
Figure 4:
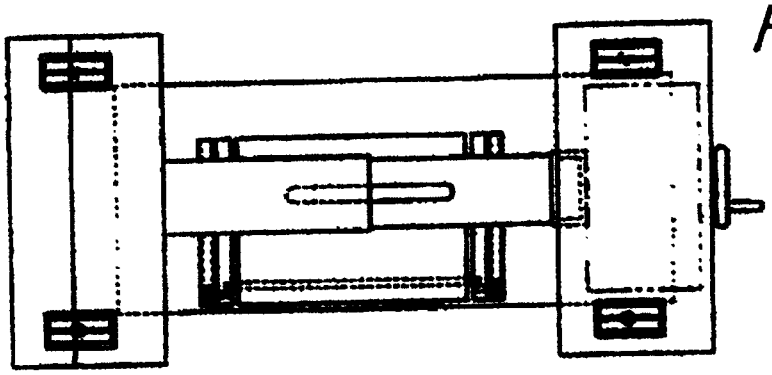
FIG. 4 is a bottom view showing the cantilevered, adjustable computer desk of the invention.

As set forth in FIG. 1, the elements of the preferred embodiment of the cantilevered, telescopic computer desk 10 comprise a base assembly 12, the base assembly having spaced apart end members 14 and 16 joined by an intermediate member 18 perpendicular thereto. The perpendicular member 18 may be fixed or adjustable. Castors 22,23,24,25 are affixed to the base assembly 12, preferably on the underside of the end members 14 and 16 to support the base assembly 12 above the floor and permit the computer desk 10 to be moved about and easily portable. The castors may include braking elements that may be locked to secure the computer desk in position.

Upstanding from one end of the base assembly 12 is a vertical telescopic support member 20 which carries a cantilevered desk member 30 parallel to the base assembly 12 so as to extend in the same direction from the telescopic support. Thus, the base assembly 12 may be rolled up to or positioned underneath a bed, sofa, recliner, or chair 28 so that the desk member 30 is cantilevered over the user. The vertical telescopic support member 20 provides a means for adjusting the height of the cantilevered desk member 30 accommodating user positions ranging from standing to seating to lying. In an alternative embodiment, the cantilevered desk member 30 may also have a means for tilting 33 the desk member 30 at an angle toward or away from the user or parallel to the base assembly 12.

The cantilevered desk member 30 has a means to receive a computer monitor 34 and to provide a computer user space to work or space for receiving other items, such as, for example, a book holder, a television, or to permit unobstructed viewing of a television placed in a remote location in the room. In the drawings, the computer monitor is depicted in the center 36 of the cantilevered desk member 30. However, in application, the inventor prefers the screen to be located to the right side 38 of the cantilevered desk member 30 to permit greater free space on the left side 40 of the cantilevered desk member 30. The computer monitor 34 is also known as a computer screen. The computer monitor 34 may be affixed to a computer monitor base 35. The computer monitor base 35 may be attached to the desk member 30 such that the computer screen is adjustable and may tilt or swivel to suit the needs of the user. It is irrelevant to the invention whether the computer monitor is a standard cathode ray tube (CRT), a flat screen monitor or any other type of monitor device.

Figure 2:
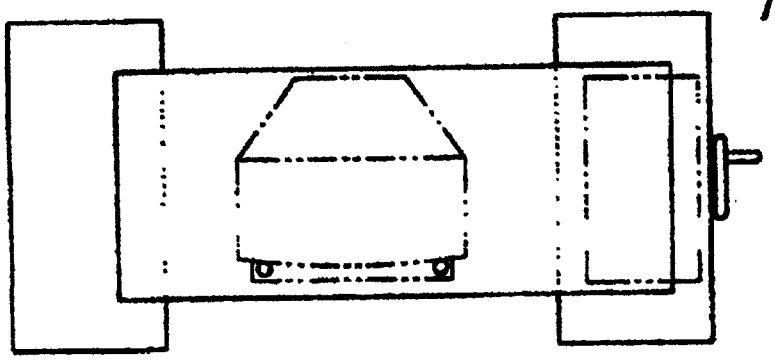
FIG. 2 is a top view showing the cantilevered, adjustable computer desk of the invention.
Figure 2A:
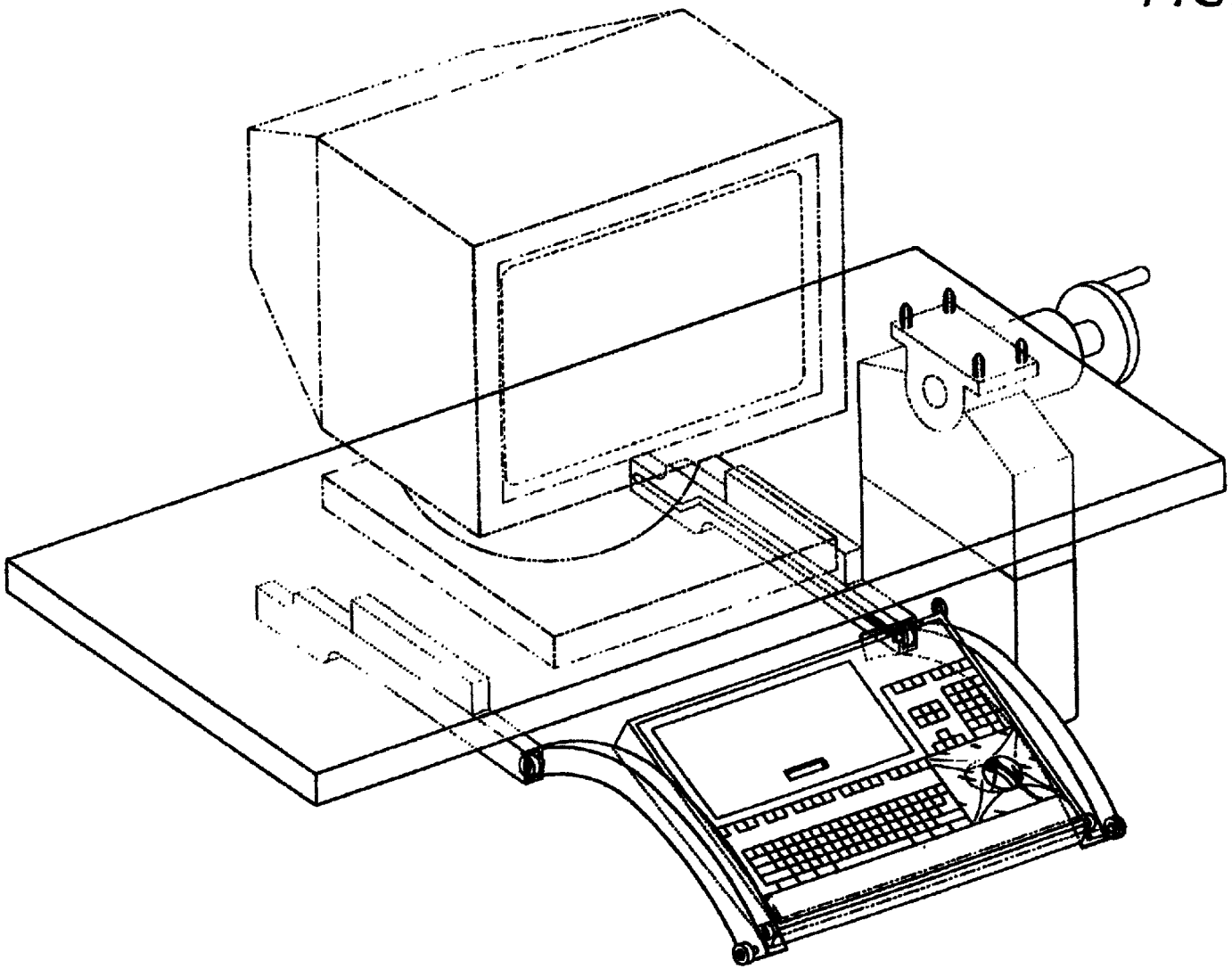
FIG. 2A is a view of the desk member of the cantilevered, adjustable computer desk of the invention.
Figure 5:
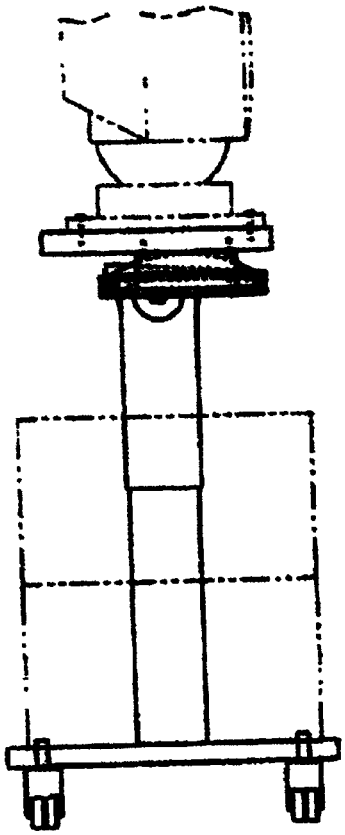
FIG. 5 is a left side view showing the cantilevered, adjustable computer desk of the invention.
Figure 6:
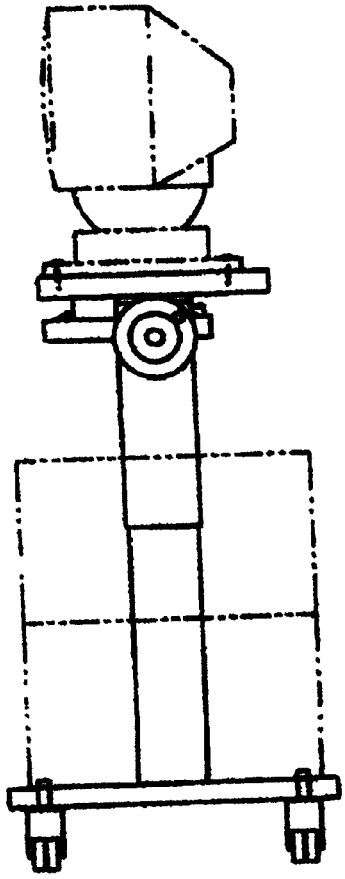
FIG. 6 is a right side view showing the cantilevered, adjustable computer desk of the invention.
Figure 9:
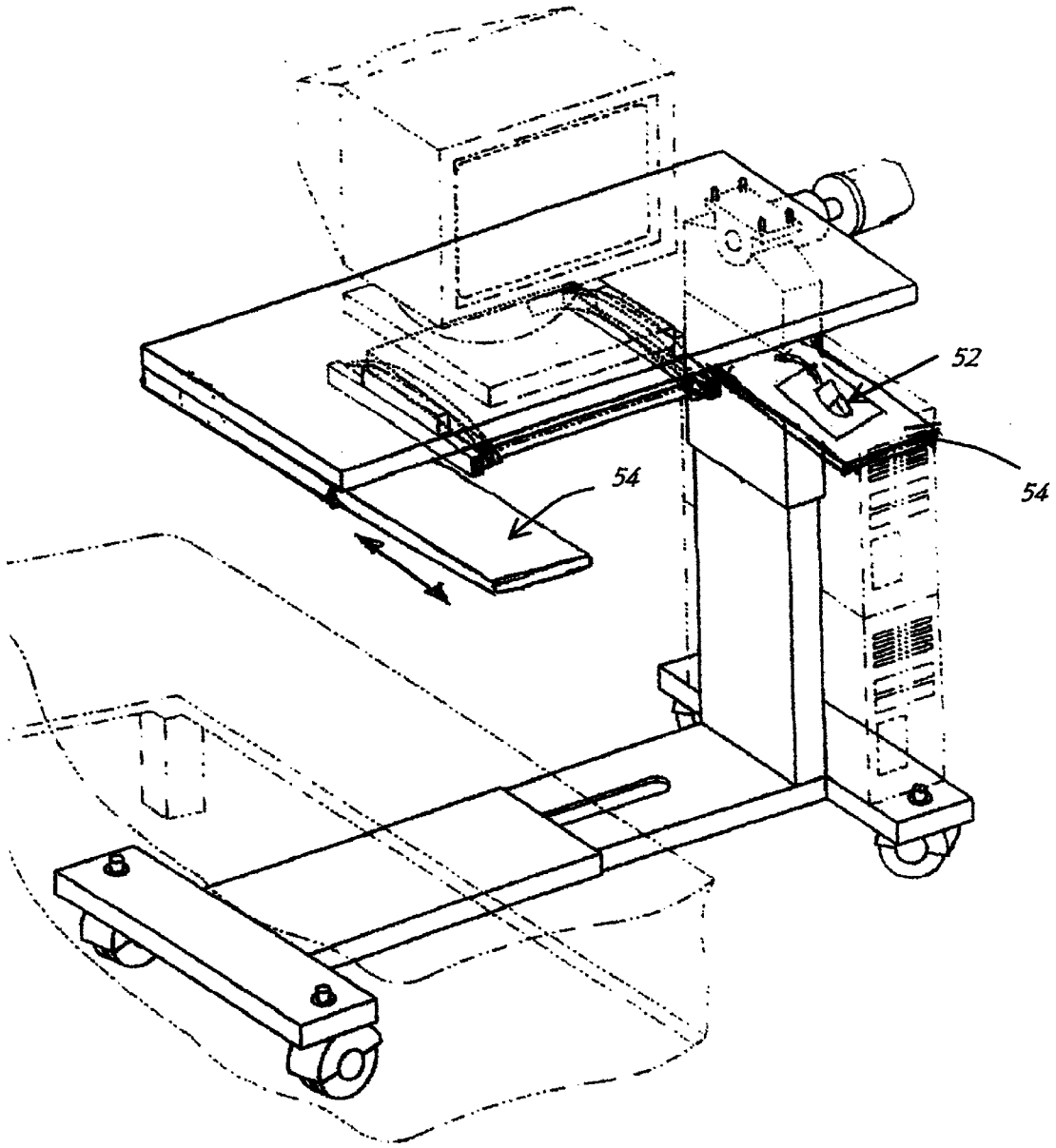
FIG. 9 is a view showing the adjustable means to receive a pad and a mouse, the adjustable side arm platens, and a means for lighting.

The cantilevered desk member 30 has a means to receive a keyboard 42 such as a retractable keyboard drawer 44 affixed to the under side 31 of the cantilevered desk member 30. As suggested in FIG. 2A, the keyboard drawer 44 may have a means to adjust the angle 46 of the keyboard 44 relative to the user. The adjusting means may be located on the drawer glides 48. The keyboard adjusting means may be located inside 43 the keyboard drawer 44. Or, the adjusting means may be affixed to the under side 43 of the keyboard 42. It is not relevant to the invention exactly how the keyboard adjusts to the user. The adjusting means may be by any means available including merely wedging the keyboard at a comfortable angle between the lip 47 of the drawer 44 and the leading edge 32 of the desk member 30.

The cantilevered computer desk 10 may also have affixed thereto an adjustable means to receive a pad and a mouse. The cantilevered computer desk 10 may also have affixed thereto adjustable side arms. The computer desk may also have a means for lighting.

The vertical telescopic support member 20 has a means to receive 21 any type of computer including but not limited to a standard computer 50 and a means to receive a printer or other electronic devices. Furthermore, the vertical telescopic support member 20 may be hollow in the center 62 for housing within the vertical support section the various electrical wires (i.e., fiber optic, analog, digital, cable, video or audio) of the electronic devices. The computer desk 10 may have a power strip 64 affixed to base end member 16 and/or the vertical support member 20.

SCOPE OF THE INVENTION

The above-presented description of the best mode contemplated of carrying out the present invention and of the manner and process with making and using it is in such a full, clear, concise and exact terms as to enable to any person skilled in the art to which it pertains to make and use this invention.

This invention is however, susceptible to modifications and alternate constructions from that disclosed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims which particularly point out and distinctly claim the subject matter of the invention.

What is claimed is:

1. A cantilevered computer desk for supporting computer components in such a fashion to be easily usable by a person whether sitting in a chair, confined to a wheelchair, reclining in a recliner, lying in bed or on a sofa or standing, said computer desk comprising:

a base assembly, said base assembly having two base end members and an intermediate member affixed to and between said end members, said base assembly having a plurality of castors affixed thereto;

a vertical support member, said vertical support member having a height adjustment means, said vertical support member being affixed at a first end to said base assembly at one of the end members, said vertical support member having a horizontal member extending outwardly from the base assembly member said horizontal member defining a means for receiving a computer;

a cantilevered desk member, said desk member affixed to said vertical support member at a second end of said vertical support member, said cantilevered desk member having a means for receiving a keyboard; said cantilevered desk member having a means for receiving a computer monitor;

said vertical support member having a means for adjusting said cantilevered desk member horizontally and parallel to said base assembly.

2. The cantilevered computer desk of claim 1 wherein at least one base end member has a means for receiving a power strip.

3. The cantilevered computer desk of claim 1 wherein the vertical support member has a means for receiving a power strip.

4. The cantilevered computer desk of claim 1 wherein the vertical support member has an internal chamber for receiving wires.

5. The cantilevered computer desk of claim 1 wherein the vertical support member has a horizontal member affixed to said vertical support member said horizontal member extending outwardly defining a means for receiving a printer.

6. The cantilevered computer desk of claim 1 wherein the vertical support member has a horizontal member affixed to said vertical support member said horizontal member extending outwardly defining a means for receiving electronic devices.

7. The cantilevered computer desk of claim 1 wherein the desk member has a means for tilting.

8. The cantilevered computer desk of claim 1 wherein the intermediate member of the base assembly may be of an adjustable length.

9. The cantilevered computer desk of claim 1 having a drawer for receiving said computer keyboard.

10. The cantilevered computer desk of claim 9 wherein said keyboard drawer is actuated by a gliding mechanism.

11. The cantilevered computer desk of claim 9 wherein the keyboard drawer is located under said desk member.

12. The cantilevered computer desk of claim 11 wherein the keyboard has a means for being adjusted relative to the user.

13. The cantilevered computer desk of claim 12 wherein the keyboard adjustment means is located within said glides of said keyboard drawer.

14. The cantilevered computer desk of claim 12, wherein the keyboard adjustment means is located within said keyboard drawer.

15. The cantilevered computer desk of claim 11, wherein the adjustment means is located behind said keyboard.

16. The cantilevered computer desk of claim 1 wherein the adjustment means of the desk member is motorized.

17. The cantilevered computer desk of claim 1 wherein the adjustment means of the desk member is gears.

18. The cantilevered computer desk of claim 1 wherein the adjustment means of the desk member is friction.

19. The cantilevered computer desk of claim 1 wherein the adjustment means of the desk member is a rack and pinion.

20. The cantilevered computer desk of claim 1 having an adjustable side arm platen.

21. The cantilevered computer desk of claim 1 having a plurality of adjustable side arm platens.

* * * * *